US010309684B1

(12) United States Patent
Taylor, Jr.

(10) Patent No.: US 10,309,684 B1
(45) Date of Patent: Jun. 4, 2019

(54) AIR FLOW DIRECTOR

(71) Applicant: Richard Ellis Taylor, Jr., Delray Beach, FL (US)

(72) Inventor: Richard Ellis Taylor, Jr., Delray Beach, FL (US)

( * ) Notice: Subject to any disclaimer, the term of this patent is extended or adjusted under 35 U.S.C. 154(b) by 144 days.

(21) Appl. No.: 15/444,479

(22) Filed: Feb. 28, 2017

(51) Int. Cl.
*F24F 13/06* (2006.01)
*F24F 13/08* (2006.01)
*F24F 13/14* (2006.01)

(52) U.S. Cl.
CPC ..... *F24F 13/084* (2013.01); *F24F 13/14* (2013.01); *F24F 2013/146* (2013.01)

(58) Field of Classification Search
CPC ..... F24F 13/08; F24F 13/06; F24F 13/082; F24F 13/084
See application file for complete search history.

(56) References Cited

U.S. PATENT DOCUMENTS

D30,059 S * 1/1899 Tracy ..... D23/387
1,624,226 A * 4/1927 Elters ..... F24F 13/00 16/270
2,080,726 A * 5/1937 Lowinger ..... B01D 46/10 160/19
2,161,001 A * 6/1939 Bedol ..... E06B 7/02 160/104
2,249,308 A * 7/1941 Bedol ..... F24F 3/1603 454/307
3,225,679 A * 12/1965 Meyer ..... F24F 13/08 220/326
3,358,578 A * 12/1967 Meyer ..... F24F 13/08 454/307
4,602,556 A * 7/1986 Gladden ..... F24F 13/08 454/307
5,088,540 A * 2/1992 Harris ..... E06B 7/02 160/90
6,558,248 B1 * 5/2003 Moore, Jr. ..... F24F 13/084 160/106
6,929,542 B1 * 8/2005 Stravitz ..... F24F 13/06 454/304
7,635,298 B2 * 12/2009 Henneberry ..... F24F 13/06 454/284
8,342,923 B2 * 1/2013 Mavroudis ..... F24F 13/082 454/275
8,460,075 B2 * 6/2013 Mavroudis ..... F24F 13/084 454/275

(Continued)

FOREIGN PATENT DOCUMENTS

WO 2011144896 A2 11/2011

*Primary Examiner* — Helena Kosanovic

(57) ABSTRACT

The air flow director is configured for use with a grille associated with an HVAC system. The air flow director attaches directly to the grille. The air flow director changes the direction of the air flow through the grille in a traverse direction and a lateral direction. The traverse angle of the deflection of the air flow is adjustable. The lateral angle of the deflection of the air flow is adjustable. The air flow director can be rotated around both a lateral axis of rotation and a traverse axis of rotation without being disconnected from the grille. The air flow director comprises a first triangular panel, a second triangular panel, a deflection panel, and a fastener. The first triangular panel, and the second triangular panel are attached to the deflection panel. The fastener attaches the deflection panel to the grille.

15 Claims, 4 Drawing Sheets

(56) References Cited

U.S. PATENT DOCUMENTS

| | | | | |
|---|---|---|---|---|
| 9,644,859 | B2 * | 5/2017 | Migliore | F24F 13/065 |
| 2008/0160904 | A1 * | 7/2008 | Yi | F24F 13/06<br>454/309 |
| 2013/0331023 | A1 * | 12/2013 | Yalmeh | F24F 13/1426<br>454/275 |

* cited by examiner

AIR FLOW DIRECTOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of lighting and heating including air conditioning and ventilation, more specifically, a ducting arrangement.

SUMMARY OF INVENTION

The air flow director is a structure that is configured for use with an HVAC system. The air flow director is configured for use with a grille associated with the HVAC system. Specifically, the air flow director is a device that attaches to the grille for the purpose of changing the direction of the flow of air that is discharged through the grille. The air flow director attaches directly to the grille. The air flow director changes the direction of the air flow through the grille in a traverse direction and a lateral direction. The traverse angle of the deflection of the air flow is adjustable. The lateral angle of the deflection of the air flow is adjustable. The air flow director can be rotated around both a lateral axis of rotation and a traverse axis of rotation without being disconnected from the grille.

These together with additional objects, features and advantages of the air flow director will be readily apparent to those of ordinary skill in the art upon reading the following detailed description of the presently preferred, but nonetheless illustrative, embodiments when taken in conjunction with the accompanying drawings.

In this respect, before explaining the current embodiments of the air flow director in detail, it is to be understood that the air flow director is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the air flow director.

It is therefore important that the claims be regarded as including such equivalent construction insofar as they do not depart from the spirit and scope of the air flow director. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
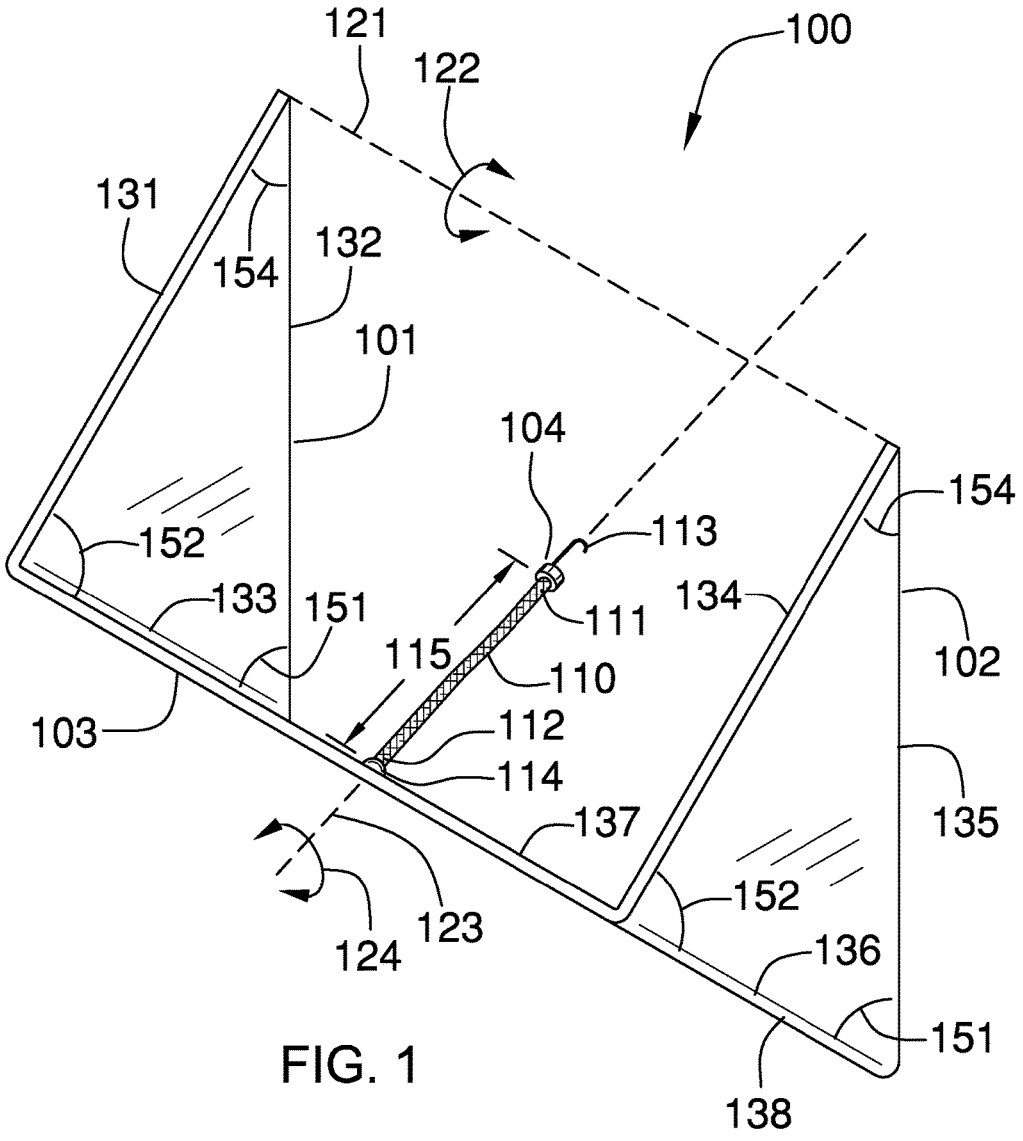
FIG. 1 is a perspective view of an embodiment of the disclosure.
Figure 2:
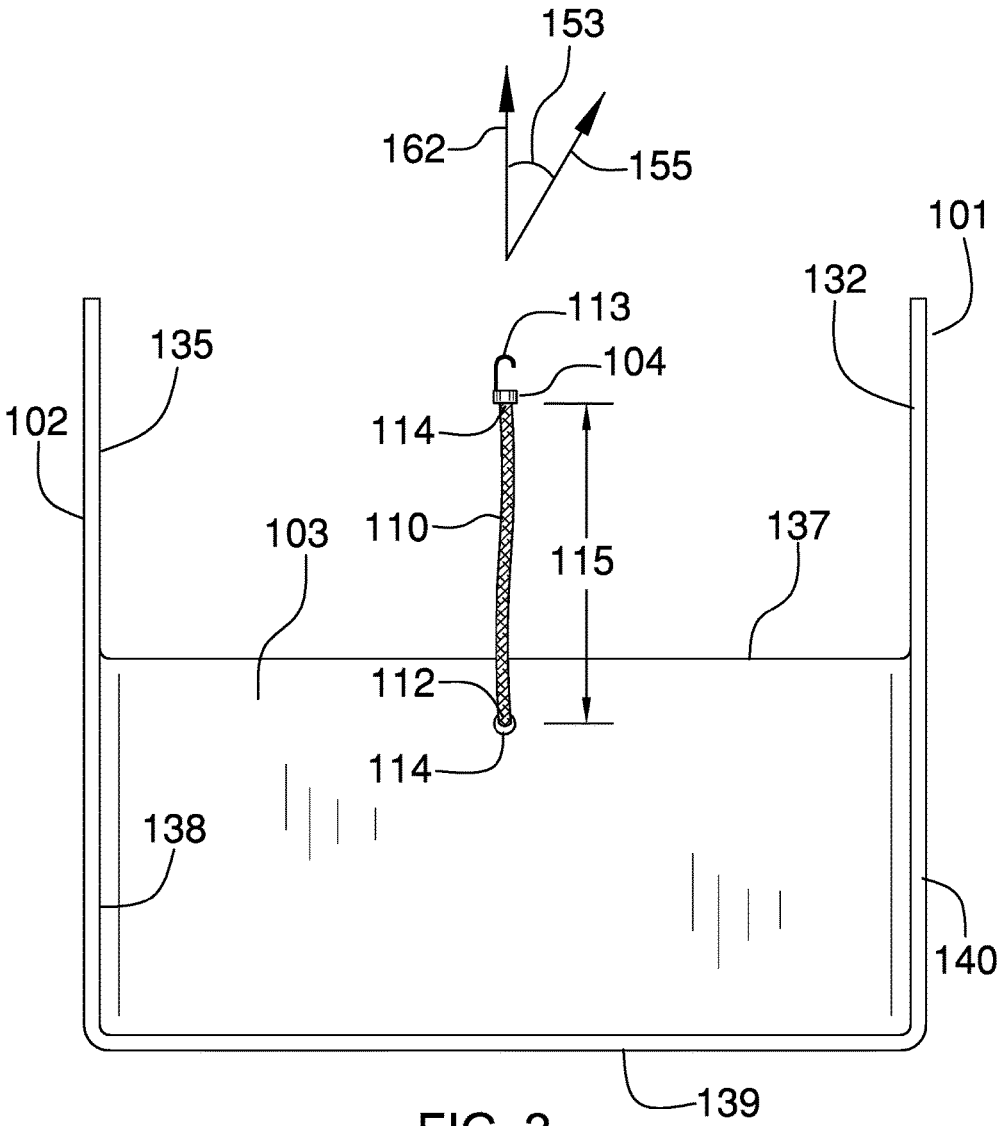
FIG. 2 is a rear view of an embodiment of the disclosure.
Figure 3:
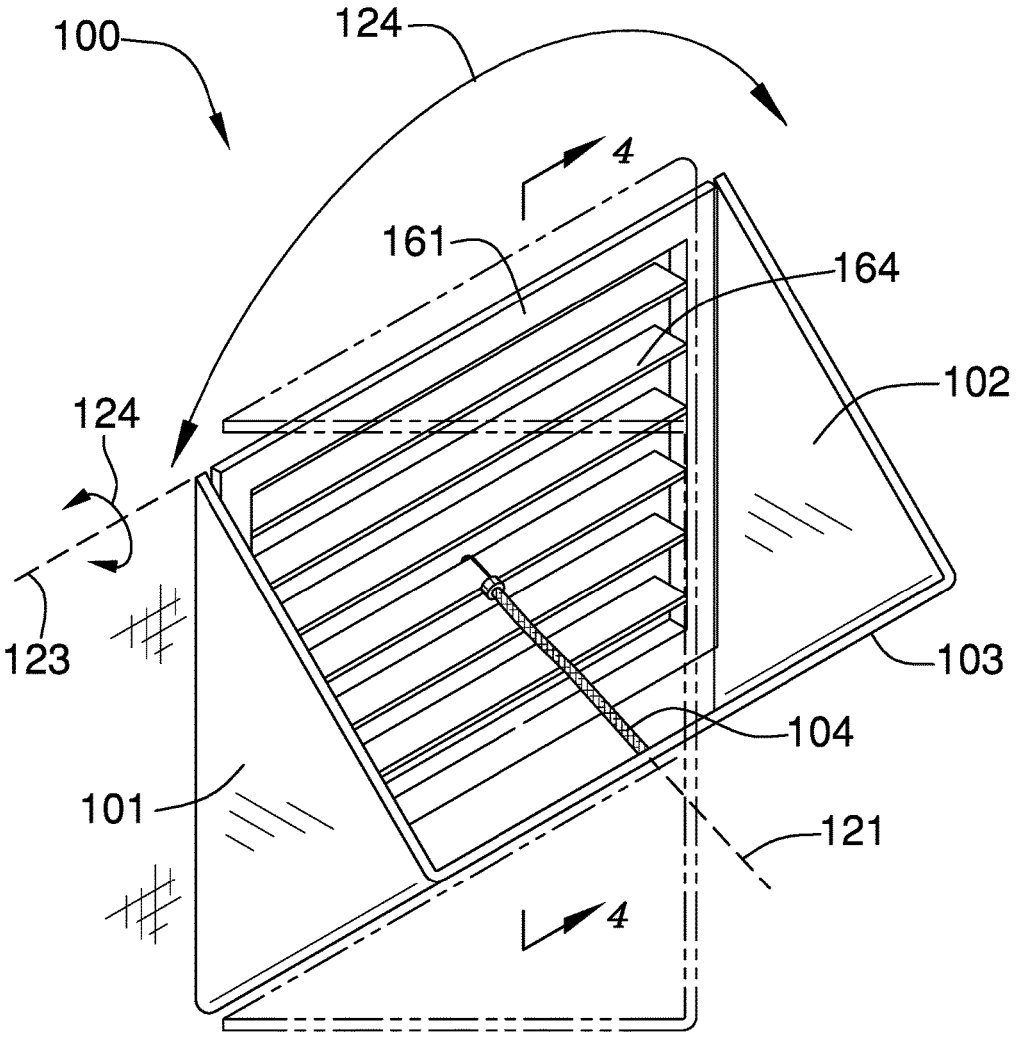
FIG. 3 is an in use view of an embodiment of the disclosure.
Figure 4:
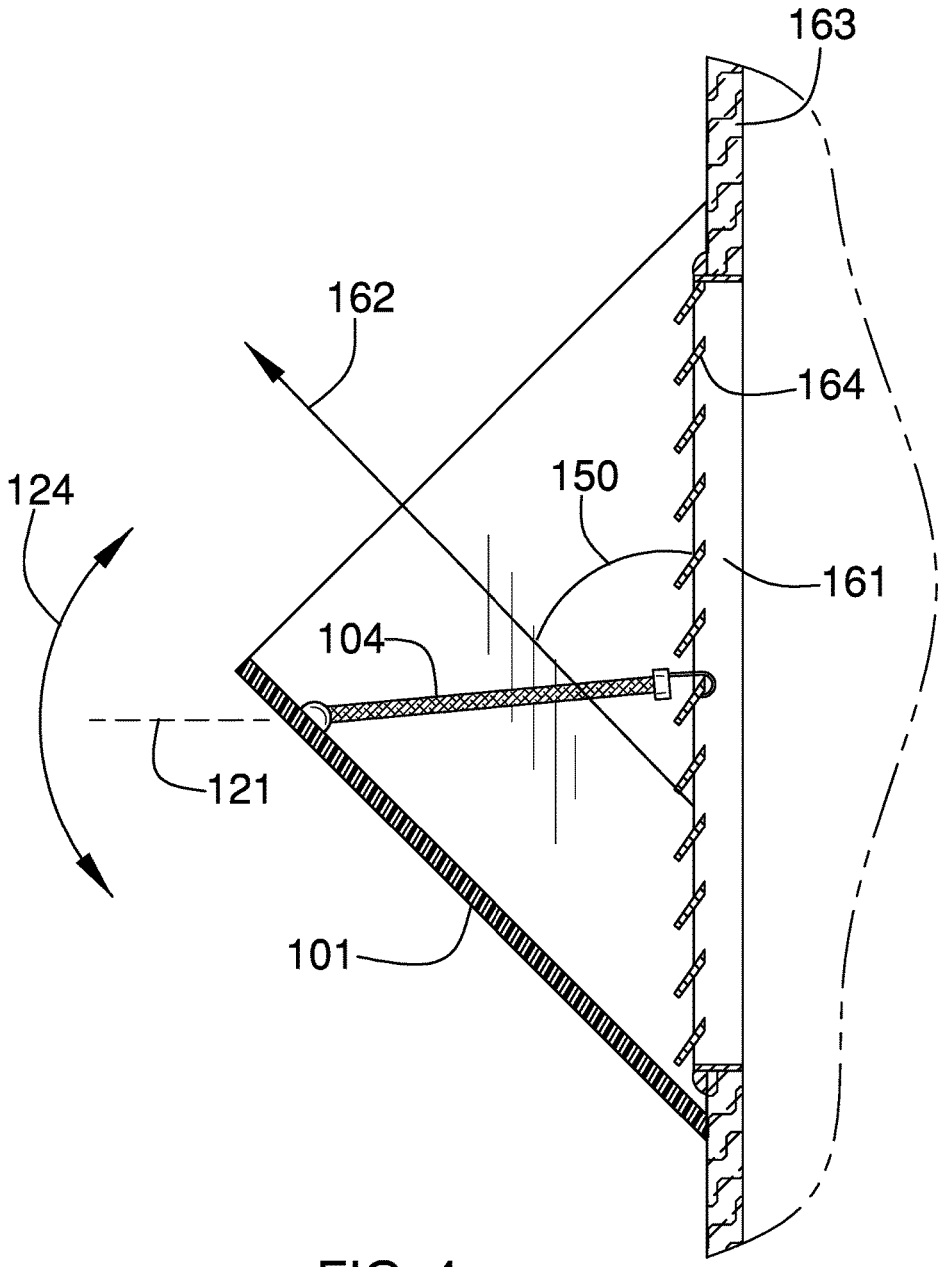
FIG. 4 is a cross-sectional view of an embodiment of the disclosure across 4-4 as shown in FIG. 4.

Detailed reference will now be made to one or more potential embodiments of the disclosure, which are illustrated in FIGS. 1 through 4.

The air flow director 100 (hereinafter invention) is a structure that is configured for use with an HVAC system. The invention 100 is configured for use with a grille 161 associated with the HVAC system. The grille 161 is a commercially available HVAC component that is commonly referred to as a grille 161 or a register. The grille 161 is an openwork barrier that is place upon a vent. Specifically, the invention 100 is a device that attaches to the grille 161 for the purpose of changing the direction of the flow of air that is discharged through the grille 161. The invention 100 attaches directly to the grille 161. The invention 100 changes the direction of the air flow through the grille 161 in a traverse direction and a lateral direction.

The invention 100 comprises a lateral rotation 121 around a lateral axis of rotation 122 and a traverse rotation 123 around a traverse axis of rotation 124. The lateral rotation 121 does not require the invention 100 to be disconnected from the grille 161. The traverse rotation 123 does not require the invention 100 to be disconnected from the grille 161. The rotation of the invention 100 around the lateral axis of rotation 122 adjusts a lateral deflection angle 153 of the air flow. The rotation of the invention 100 around the traverse axis of rotation 124 adjusts a traverse deflection angle 150 of the air flow. The invention 100 comprises a first triangular panel 101, a second triangular panel 102, a deflection panel 103, and a fastener 104. The first triangular panel 101 and the second triangular panel 102, are attached to the deflection panel 103. The fastener 104 attaches the deflection panel 103 to the grille 161.

Within this disclosure, a wall 163 refers to a vertical surface within which the grille 161 has been installed. It is explicitly acknowledged that a grille 161 can be used with a floor-mounted vent. However, the specification and claims of this disclosure will hereinafter implicitly assume that the grille 161 is mounted in a vertical wall 163. This assumption is made for the purposes of simplicity and for clarity of exposition of the disclosure is not intended to limit the scope of the appended claims. Those skilled in the art will recognize that the innovations described in this disclosure can be readily modified to accommodate a grille 161 mounted in a horizontal surface, such as a floor or a ceiling with a minimum of modification and experimentation.

Within this disclosure, a bar 164 refers to shaft structures that are used to form the openwork of the grille 161.

Within this disclosure, an air flow vector 162 is a hypothetical vector that describes the movement of air flow out of the invention 100. Specifically the air flow vector 162 describes the direction of movement of the center mass of the airflow discharged from the invention 100. The air flow vector 162 is further defined with the traverse deflection angle 150 and the lateral deflection angle 153. The traverse deflection angle 150 is defined as the cant between the surface of the wall 163 and the air flow vector 162. The lateral deflection angle 153 is defined as the cant between the geometric projection of the air flow vector 162 on the wall 163 and a hypothetical reference line 155, generally taken to be a vertical line, formed within the plane of the wall 163 that passes through the center of the grille 161. The air flow vector 162, the traverse deflection angle 150 and the lateral deflection angle 153 are used as a directional reference throughout this disclosure. The invention 100 provides for the adjustment of the traverse deflection angle 150 and the lateral deflection angle 153 such that the air flow vector 162 of the airflow discharged from the invention 100 can be controlled.

The first triangular panel 101 is a solid plate structure that is formed in the shape of a scalene triangle. The second triangular panel 102 is a solid plate structure that is formed in the shape of a scalene triangle. The first triangular panel 101 and the second triangular panel 102 have identical form factors. The first triangular panel 101 is further defined with a first edge 131, a second edge 132, and a third edge 133. The second triangular panel 102 is further defined with a fourth edge 134, a fifth edge 135, and a sixth edge 136. The first triangular panel 101 is identical to the second triangular panel 102.

The first triangular panel 101 and the second triangular panel 102 are both further defined with a primary traverse deflection angle 151, a secondary traverse deflection angle 152, and a pivot angle 154.

The primary traverse deflection angle 151 of the first triangular panel 101 is the angle formed by the intersection of the second edge 132 and the third edge 133 of the first triangular panel 101. The primary transverse deflection angle 151 of the second triangular panel 102 is the angle formed by the intersection of the fifth edge 135 and the sixth edge 136 of the second triangular panel 102.

The secondary traverse deflection angle 152 of the first triangular panel 101 is the angle formed by the intersection of the first edge 131 and the third edge 133 of the first triangular panel 101. The secondary traverse deflection angle 152 of the second triangular panel 102 is the angle formed by the intersection of the fourth edge 134 and the sixth edge 136 of the second triangular panel 102.

The pivot angle 154 of the first triangular panel 101 is the angle formed by the intersection of the first edge 131 and the second edge 132 of the first triangular panel 101. The pivot angle 154 of the second triangular panel 102 is the angle formed by the intersection of the fourth edge 134 and the fifth edge 135 of the second triangular panel 102.

The deflection panel 103 is a solid plate structure that is formed in the shape of a rectangular block. The deflection panel 103 is further defined with a seventh edge 137, an eighth edge 138, a ninth edge 139, and a tenth edge 140.

The fastener 104 is a device that attaches the invention 100 to the grille 161. The fastener 104 comprises a spring 110, a hook 113, and a flange 114. The spring 110 is further defined with a first end 111 and a second end 112.

The spring 110 is a readily and commercially available tension spring that is formed in the shape of a tube. The span of the spring 115 is selected such that the spring 110 is under tension when the invention 100 is attached to the grille 161. The span of the spring 115 refers to the distance between the first end 111 of the spring 110 and the second end 112 of the spring 110. A measurement of the span of the spring 115 is taken when: 1) the spring 110 is in its relaxed shape; and, 2) the center axis of the spring 110 forms a straight line. In the first potential embodiment of the disclosure, the spring 110 is a bungee cord.

The hook 113 is a readily and commercially hardware item that attaches the first end 111 of the spring 110 to the grille 161. The flange 114 is a readily and commercially hardware item that attaches the second end 112 of the spring 110 to the deflection panel 103.

The third edge 133 of the first triangular panel 101 attaches to the tenth edge 140 of the deflection panel 103. The sixth edge 136 of the second triangular panel 102 attaches to the eighth edge 138 of the deflection panel 103. The flange 114 attaches the second end 112 of the spring 110 to the deflection panel 103. The hook 113 attaches to the first end 111 of the spring 110.

The first triangular panel 101 attaches to the deflection panel 103 such that the first triangular panel 101 forms a right angle with the deflection panel 103. The second triangular panel 102 attaches to the deflection panel 103 such that the second triangular panel 102 forms a right angle with the deflection panel 103. The second triangular panel 102 is parallel to the first triangular panel 101 and projects away from the deflection panel 103 in the same direction as the first triangular panel 101.

The invention 100 attaches to the grille 161 using an arrangement selected from the group consisting of a first arrangement and a second arrangement.

In the first arrangement, the second edge 132, the fifth edge 135, and the ninth edge 139 are placed flush against the wall 163. The invention 100 attaches to the grille 161 using the hook 113 attached to the first end 111 of the spring 110. When the hook 113 is hooked around a bar 164 of the grille 161, the spring 110 is placed under tension. The counter force that prevents the spring 110 from returning to its relaxed state is transmitted through the invention 100 to the second edge 132, the fifth edge 135, and the ninth edge 139 such that the second edge 132, the fifth edge 135, and the ninth edge 139 are held flush against the wall 163. The air flowing through the grille 161 deflects against the deflection panel 103 before exiting the invention 100 in the direction of the air flow vector 162. Using the first arrangement, the traverse deflection angle 150 formed by this deflection is equal to the primary traverse deflection angle 151 of both the first triangular panel 101 and the second triangular panel 102.

In the second arrangement, the first edge 131, the fourth edge 134, and the seventh edge 137 are placed flush against the wall 163. The invention 100 attaches to the grille 161 using the hook 113 attached to the first end 111 of the spring 110. When the hook 113 is hooked around a bar 164 of the grille 161, the spring 110 is placed under tension. The counter force that prevents the spring 110 from returning to its relaxed state is transmitted through the invention 100 to the first edge 131, the fourth edge 134, and the seventh edge 137 such that the first edge 131, the fourth edge 134, and the seventh edge 137 are held flush against the wall 163. The air flowing through the grille 161 deflects against the deflection panel 103 before exiting the invention 100 in the direction of the air flow vector 162. Using the second arrangement, the traverse deflection angle 150 formed by this deflection is equal to the secondary traverse deflection angle 152 of both the first triangular panel 101 and the second triangular panel 102.

In both the first arrangement and the second arrangement, the apex of the pivot angle 154 of the first triangular panel 101 and the apex of the pivot angle 154 of the second triangular panel 102 will be in contact with the wall 163.

The traverse deflection angle 150 is adjusted by changing between the first arrangement and the second arrangement of attaching the invention 100 to the grille 161. The change between the first arrangement and the second arrangement does not require that the hook 113 be unattached from the grille 161.

To switch between the first arrangement and the second arrangement requires a traverse rotation 123 of the invention 100 around the traverse axis of rotation 124. The traverse rotation 123 refers to a rotation of the invention 100 within a plane of rotation that is: 1) perpendicular to the plane of rotation of the lateral rotation 121; and, 2) that contains the hypothetical reference line 155 that is used to determine the lateral deflection angle 153. The traverse axis of rotation 124 refers to the axis of rotation around which a traverse rotation 123 of the invention 100 is made. The traverse axis of rotation 124 is a line that is formed between the apex of the pivot angle 154 of the first triangular panel 101 and the apex of the pivot angle 154 of the second triangular panel 102. Once the rotation is complete, the invention 100 is placed in its final position by sliding the invention 100 along the wall 163.

The lateral deflection angle 153 is adjusted through a lateral rotation 121 of the invention 100 around the lateral axis of rotation 122 after the invention 100 has been attached to the grille 161 and slid into position. The term lateral rotation 121 refers to a rotation of the invention 100 within a plane of rotation that is parallel to or aligned with the plane formed by the wall 163. The lateral axis of rotation 122 refers to the axis of rotation around which a lateral rotation 121 of the invention 100 is made. The lateral axis of rotation 122 is a line that projects perpendicularly away from the wall 163. The lateral axis of rotation 122 is aligned with the center axis of the spring 110. It is expected that the lateral rotation 121 of the invention 100 around the lateral axis of rotation 122 will cause a torque within the spring 110. However, the lateral rotation 121 of the invention 100 does not require that the hook 113 be unattached from the grille 161.

The following definitions were used in this disclosure:

Align: As used in this disclosure, align refers to an arrangement of objects that are: 1) arranged in a straight line; or, 2) arranged to give a directional sense of a plurality of parallel lines.

Apex: As used in this disclosure, an apex is the point of an object that has the greatest height or altitude relative to a given reference.

Center of rotation: As used in this disclosure, the center of rotation is the point of a rotating plane that does not move with the rotation of the plane. A line within a rotating three-dimensional object that does not move with the rotation of the object is referred to as an axis of rotation.

Bungee: As used in this disclosure, the term bungee refers to an elastic cord or a mesh of elastic cords.

Cant: As used in this disclosure, a cant is an angular deviation from one or more reference planes such as a vertical plane or a horizontal plane.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Duct: As used in this disclosure, a duct is a tube, pipe, canal or channel through which air is conducted or conveyed.

Ductwork: As used in this disclosure, ductwork is a network of ducts.

Form Factor: As used in this disclosure, the term form factor refers to the size and shape of an object.

Elastic: As used in this disclosure, an elastic is a material or object that deforms when a force is applied to it and that is able to return to its original shape after the force is removed. A material that exhibits these qualities is also referred to as an elastomeric material.

Flange: As used in this disclosure, a flange is a protruding rib, edge, or collar that is used to hold an object in place or to attach a first object to a second object.

Grille: As used in this disclosure, a grille is a cover for a vent of an HVAC system. The grille comprises a barrier formed of bars or wires that allow for the passage of air through the grille while preventing solid items from passing through the grille.

Hook: As used in this disclosure, a hook is an object that is curved or bent at an angle such that items can be hung on or caught by the object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

HVAC: As used in this disclosure, HVAC is an acronym for Heating Ventilation and Air Conditioning and is a general term that refers to the air handling technology used within buildings.

Plate: As used in this disclosure, a plate is a smooth, flat and semi-rigid or rigid structure that has at least one dimension that: 1) is of uniform thickness; and 2) that appears thin relative to the other dimensions of the object.

Relaxed Shape: As used in this disclosure, a structure is considered to be in its relaxed state when no shear, strain, or torsional forces are being applied to the structure.

Scalene: As used in this disclosure, scalene is an adjective that describes a triangle that is formed from edges of three different lengths and with no two angles that are equal.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Tension Spring: As used in this disclosure, a tension spring is a spring that resists forces attempting to pull the spring in the direction of the center axis of the spring. The tension spring will return to its original position when the pulling force is removed. Extension coil springs and bungee cords are common examples of a tension spring.

Vent: As used in this disclosure, a vent is an opening in the ductwork that allows air to escape.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. An accessory for HVAC ductwork comprising:

a first triangular panel, a second triangular panel, a deflection panel, and a fastener;

wherein the first triangular panel and the second triangular panel are attached to the deflection panel;

wherein the fastener attaches the accessory for HVAC ductwork to a grille associated with an HVAC system;

wherein the grille is further defined with a bar and a wall;

wherein the accessory for HVAC ductwork attaches to the grille;

wherein the accessory for HVAC ductwork changes the direction of the flow of air that is discharged through the grille;

wherein the direction of the air flow through the grille is changed in a traverse direction and in a lateral direction;

wherein the accessory for HVAC is capable of rotation around a lateral axis of rotation and a traverse axis of rotation;

wherein the lateral rotation does not require the accessory for HVAC ductwork to be disconnected from the grille;

wherein the traverse rotation does not require the accessory for HVAC ductwork to be disconnected from the grille;

wherein the air flow is further defined with an air flow vector;

wherein specifically the air flow vector is a hypothetical vector that defines the direction of movement of the center mass of the airflow discharged from the accessory for HVAC ductwork;

wherein the air flow vector is further defined with a traverse deflection angle and a lateral deflection angle;

wherein the traverse deflection angle is defined as the cant between the surface of the wall and the air flow vector;

wherein the lateral deflection angle is defined as the cant between the geometric projection of the air flow vector on the wall and a hypothetical reference line formed within the plane of the wall that passes through the center of the grille;

wherein the accessory for HVAC ductwork provides for the adjustment of the traverse deflection angle and the lateral deflection angle such that the air flow vector of the airflow discharged from the accessory for HVAC ductwork can be controlled;

wherein the lateral rotation adjusts the lateral deflection angle of the air flow;

wherein traverse rotation adjusts the traverse deflection angle of the air flow;

wherein the first triangular panel is a solid plate structure that is formed in the shape of a scalene triangle;

wherein the second triangular panel is a solid plate structure that is formed in the shape of a scalene triangle;

wherein the first triangular panel is identical to the second triangular panel;

wherein the first triangular panel is further defined with a first edge, a second edge, and a third edge;

wherein the second triangular panel is further defined with a fourth edge, a fifth edge, and a sixth edge;

wherein the first triangular panel and the second triangular panel are both further defined with a primary traverse deflection angle, a secondary traverse deflection angle, and a pivot angle;

wherein the primary traverse deflection angle of the first triangular panel is the angle formed by the intersection of the second edge and the third edge of the first triangular panel;

wherein the primary traverse deflection angle of the second triangular panel is the angle formed by the intersection of the fifth edge and the sixth edge of the second triangular panel;

wherein the secondary traverse deflection angle of the first triangular panel is the angle formed by the intersection of the first edge and the third edge of the first triangular panel;

wherein the secondary traverse deflection angle of the second triangular panel is the angle formed by the intersection of the fourth edge and the sixth edge of the second triangular panel;

wherein the pivot angle of the first triangular panel is the angle formed by the intersection of the first edge and the second edge of the first triangular panel;

wherein the pivot angle of the second triangular panel is the angle formed by the intersection of the fourth edge and the fifth edge of the second triangular panel;

wherein the deflection panel is a solid plate structure that is formed in the shape of a rectangular block;

wherein the fastener attaches the deflection panel to the grille;

wherein the deflection panel is further defined with a seventh edge, an eighth edge, a ninth edge, and a tenth edge;

wherein the fastener is a spring wherein the spring is under tension when at least the second edge of the first triangular panel and the fifth edge of the second triangular panel are in contact with the wall.

2. The accessory for HVAC ductwork according to claim 1 wherein the fastener comprises a spring, a hook, and a flange;

wherein the spring is further defined with a first end and a second end;

wherein the spring is a tension spring that is formed in the shape of a tube;

wherein the hook attaches to the first end of the spring;

wherein the hook attaches to the fastener to the grille;

wherein the flange attaches to the deflection panel;

wherein the flange attaches the second end of the spring to the deflection panel.

3. The accessory for HVAC ductwork according to claim 2 wherein the spring is further defined with a span;

wherein the span of the spring refers to the distance between the first end of the spring and the second end of the spring;

wherein the span of the spring is selected such that the spring is under tension when the accessory for HVAC ductwork is attached to the grille.

4. The accessory for HVAC ductwork according to claim 3 wherein the third edge of the first triangular panel attaches to the tenth edge of the deflection panel;

wherein the sixth edge of the second triangular panel attaches to the eighth edge of the deflection panel.

5. The accessory for HVAC ductwork according to claim 4 wherein the first triangular panel attaches to the deflection panel such that the first triangular panel forms a right angle with the deflection panel;

wherein the second triangular panel attaches to the deflection panel such that the second triangular panel forms a right angle with the deflection panel;

wherein the second triangular panel is parallel to the first triangular panel and projects away from the deflection panel in the same direction as the first triangular panel.

6. The accessory for HVAC ductwork according to claim 5 wherein the accessory for HVAC ductwork attaches to the grille using an arrangement selected from the group consisting of a first arrangement and a second arrangement;

wherein the traverse deflection angle is adjusted by changing between the first arrangement and the second arrangement.

7. The accessory for HVAC ductwork according to claim 6 wherein the first arrangement comprises placing the second edge, the fifth edge, and the ninth edge flush against the wall;

wherein the fastener attaches to the grille using the hook attached to the first end of the spring;

wherein when the hook is hooked around the bar of the grille such that the spring is placed under tension;

wherein the first arrangement sets the traverse deflection angle equal to the primary traverse deflection angle.

8. The accessory for HVAC ductwork according to claim 7 wherein the second arrangement comprises placing the first edge, the fourth edge, and the seventh edge against the wall;

wherein the fastener attaches to the grille using the hook attached to the first end of the spring;

wherein when the hook is hooked around the bar of the grille such that the spring is placed under tension;

wherein the second arrangement sets the traverse deflection angle equal to the secondary traverse deflection angle.

9. The accessory for HVAC ductwork according to claim 8 wherein the change between the first arrangement and the second arrangement requires a traverse rotation of the accessory for HVAC ductwork around the traverse axis of rotation;

wherein the traverse rotation is rotation of the accessory for HVAC ductwork within a traverse plane of rotation;

wherein the traverse plane of rotation is perpendicular to the plane of rotation of the lateral rotation;

wherein the traverse plane of rotation contains the hypothetical reference line.

10. The accessory for HVAC ductwork according to claim 9 wherein the traverse axis of rotation is the axis of rotation around which a traverse rotation of the accessory for HVAC ductwork is made;

wherein the traverse axis of rotation is a line that is formed between the apex of the pivot angle of the first triangular panel and the apex of the pivot angle of the second triangular panel.

11. The accessory for HVAC ductwork according to claim 10 wherein the lateral deflection angle is adjusted with the lateral rotation of the accessory for HVAC ductwork;

wherein the lateral rotation comprises a rotation of the accessory for HVAC ductwork within a plane of rotation that is aligned with a surface plane formed by the wall;

wherein the lateral axis of rotation refers to the axis of rotation around which a lateral rotation of the accessory for HVAC ductwork is made;

wherein the lateral axis of rotation is a line that projects perpendicularly away from the wall;

wherein the lateral axis of rotation is aligned with the center axis of the spring.

12. The accessory for HVAC ductwork according to claim 5 wherein the lateral deflection angle is adjusted with the lateral rotation of the accessory for HVAC ductwork;

wherein the lateral rotation comprises a rotation of the accessory for HVAC ductwork within a plane of rotation that is aligned with a surface plane formed by the wall;

wherein the lateral axis of rotation refers to the axis of rotation around which a lateral rotation of the accessory for HVAC ductwork is made;

wherein the lateral axis of rotation is a line that projects perpendicularly away from the wall;

wherein the lateral axis of rotation is aligned with the center axis of the spring;

wherein the accessory for HVAC ductwork attaches to the grille using an arrangement selected from the group consisting of a first arrangement and a second arrangement;

wherein the traverse deflection angle is adjusted by changing between the first arrangement and the second arrangement.

13. The accessory for HVAC ductwork according to claim 12 wherein the first arrangement comprises placing the second edge, the fifth edge, and the ninth edge flush against the wall;

wherein the fastener attaches to the grille using the hook attached to the first end of the spring;

wherein when the hook is hooked around the bar of the grille such that the spring is placed under tension;

wherein the first arrangement sets the traverse deflection angle equal to the primary traverse deflection angle.

14. The accessory for HVAC ductwork according to claim 13 wherein the second arrangement comprises placing the first edge, the fourth edge, and the seventh edge against the wall;

wherein the fastener attaches to the grille using the hook attached to the first end of the spring;

wherein when the hook is hooked around the bar of the grille such that the spring is placed under tension;

wherein the second arrangement sets the traverse deflection angle equal to the secondary traverse deflection angle.

15. The accessory for HVAC ductwork according to claim 14 wherein the change between the first arrangement and the second arrangement requires a traverse rotation of the accessory for HVAC ductwork around the traverse axis of rotation;

wherein the traverse rotation is rotation of the accessory for HVAC ductwork within a traverse plane of rotation;

wherein the traverse plane of rotation is perpendicular to the plane of rotation of the lateral rotation;

wherein the traverse plane of rotation contains the hypothetical reference line;

wherein the traverse axis of rotation is the axis or rotation around which a traverse rotation of the accessory for HVAC ductwork is made;

wherein the traverse axis of rotation is a line that is formed between the apex of the pivot angle of the first triangular panel and the apex of the pivot angle of the second triangular panel.

* * * * *